US009001162B2

(12) United States Patent
No et al.

(10) Patent No.: US 9,001,162 B2
(45) Date of Patent: Apr. 7, 2015

(54) DISPLAY APPARATUS

(75) Inventors: Sang-Yong No, Asan-si (KR); Yoon-Jang Kim, Seoul (KR); Sang-Ki Kwak, Asan-si (KR)

(73) Assignee: Samsung Display Co., Ltd., Yongin (KR)

( * ) Notice: Subject to any disclaimer, the term of this patent is extended or adjusted under 35 U.S.C. 154(b) by 367 days.

(21) Appl. No.: 13/104,280

(22) Filed: May 10, 2011

(65) Prior Publication Data

US 2012/0162273 A1 Jun. 28, 2012

(30) Foreign Application Priority Data

Dec. 27, 2010 (KR) ..... 10-2010-0135626

(51) Int. Cl.
*G09G 3/36* (2006.01)

(52) U.S. Cl.
CPC ..... *G09G 3/3648* (2013.01); *G09G 2300/0852* (2013.01)

(58) Field of Classification Search
CPC ..... G09G 2300/0852; G09G 3/3648
USPC ..... 345/76, 690; 349/38, 43
See application file for complete search history.

(56) References Cited

U.S. PATENT DOCUMENTS

2004/0032544 A1* 2/2004 Kim et al. ..... 349/40
2007/0075937 A1* 4/2007 Kim ..... 345/76
2008/0024689 A1* 1/2008 Ahn ..... 349/43
2009/0268112 A1* 10/2009 Lu et al. ..... 349/38

FOREIGN PATENT DOCUMENTS

KR 10-2009-0088729 8/2009

* cited by examiner

*Primary Examiner* — Quan-Zhen Wang
*Assistant Examiner* — Tony Davis
(74) *Attorney, Agent, or Firm* — H.C. Park & Associates, PLC

(57) ABSTRACT

A display apparatus includes a plurality of pixels. Each pixel includes a first sub-pixel that is charged with a data signal corresponding to an input gray-scale, in response to a gate signal, and a second sub-pixel that is charged with the data signal in response to the gate signal. A boost capacitor is disposed between the first and second sub-pixels. The boost capacitor increases the voltage of the signal charged in the first sub-pixel and decreases the voltage of the signal charged in the second sub-pixel. Each pixel further includes an initializing device to initialize a first electrode of the boost capacitor and a switching device to change an electric potential of the first electrode of the boost capacitor.

9 Claims, 8 Drawing Sheets

DISPLAY APPARATUS

CROSS-REFERENCE TO RELATED APPLICATION

This application claims priority from and the benefit of Korean Patent Application No. 10-2010-0135626 filed on Dec. 27, 2010, which is hereby incorporated by reference for all purposes as if fully set forth herein.

BACKGROUND

1. Field of the Disclosure

Aspects of the present invention relate to a display apparatus.

2. Description of the Related Art

A liquid crystal display includes two substrates including a pixel electrode and common electrode, and a liquid crystal layer disposed between the two substrates. The liquid crystal display applies a voltage to the pixel electrode and the common electrode to change the alignment of the liquid crystal molecules of the liquid crystal layer, to thereby display a desired image.

A vertical alignment mode liquid crystal display has a large contrast ratio and a wide viewing angle. To this end, openings or protrusions are formed in the pixel or common electrode of a vertical alignment mode liquid crystal display, to control the alignment of the liquid crystal molecules. However, the aperture ratio of the pixel is reduced by the openings or the protrusions. In addition, the vertical alignment mode liquid crystal display has a relatively lower side visibility, as compared to a front visibility thereof.

SUMMARY

Exemplary embodiments of the present invention provide a display apparatus having improved side visibility, transmittance, and aperture ratio.

An exemplary embodiment of the present invention provides a display apparatus that includes a plurality of pixels to display an image. Each pixel includes a first sub-pixel, a second sub-pixel, a boost capacitor, an initializing device, and a switching device.

The first sub-pixel is charged with a data signal corresponding to an input gray-scale, in response to a gate signal, and the second sub-pixel is charged with the data signal in response to the gate signal.

The boost capacitor is disposed between the first sub-pixel and the second sub-pixel, to increase the voltage of the signal charged in the first sub-pixel to a voltage corresponding to a gray-scale that is higher than the input gray-scale, and to decrease the voltage of the signal charged in the second sub-pixel to a voltage corresponding to a gray-scale that is lower than the input gray-scale. The initializing device applies an initializing voltage to a first electrode of the boost capacitor to initialize the first electrode. The switching device includes a gate electrode in a floating state and is connected to the second sub-pixel and the boost capacitor, to change an electric potential of the first electrode.

An exemplary embodiment of the present invention discloses a display apparatus that includes a plurality of pixels to display an image. Each pixel includes a gate line that receives a gate signal, a data line that crosses the gate line and receives a data signal, a pixel electrode including a first sub-pixel electrode and a second sub-pixel electrode, a first switching device connected to the gate line, the data line, and the first sub-pixel electrode, a second switching device connected to the gate line, the data line, and the second sub-pixel electrode, a boost capacitor connected to the first sub-pixel electrode, a third switching device connected to the gate line, the boost capacitor, and the second sub-pixel electrode, and a fourth switching device connected to the second sub-pixel electrode and the boost capacitor.

According to various embodiments, the display apparatus divides one pixel electrode into a pair of sub-pixels and generates a difference between pixel voltages respectively applied to the sub-pixels, by using a charge-sharing scheme, thereby improving the side visibility of the display apparatus.

In addition, the switching device is connected to a terminal of a charge-sharing capacitor to share the charge, to increase the difference between the pixel voltages applied to the sub-pixels, and thereby further improve the side visibility.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Figure 1:
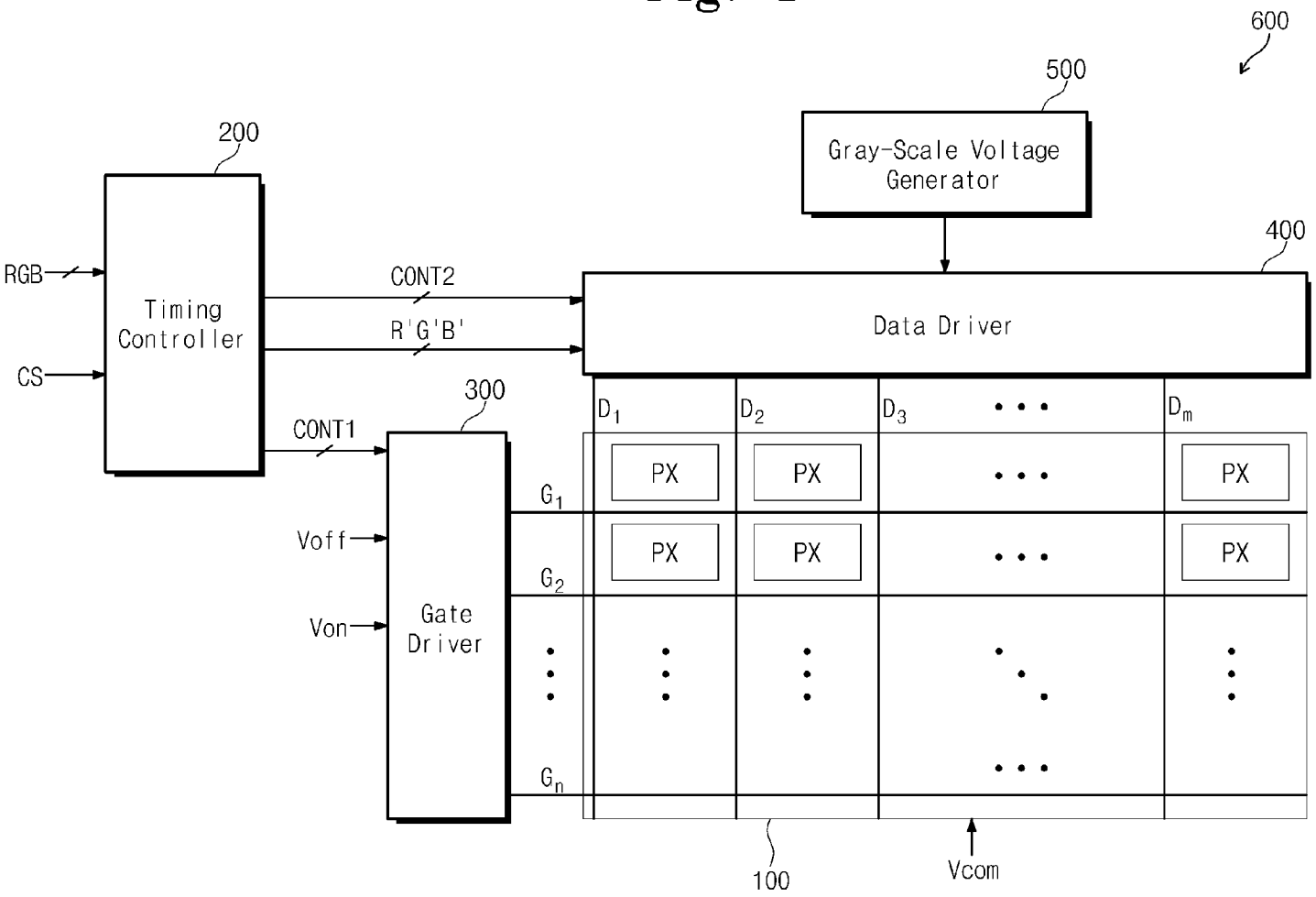
FIG. 1 is a block diagram showing a liquid crystal display, according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
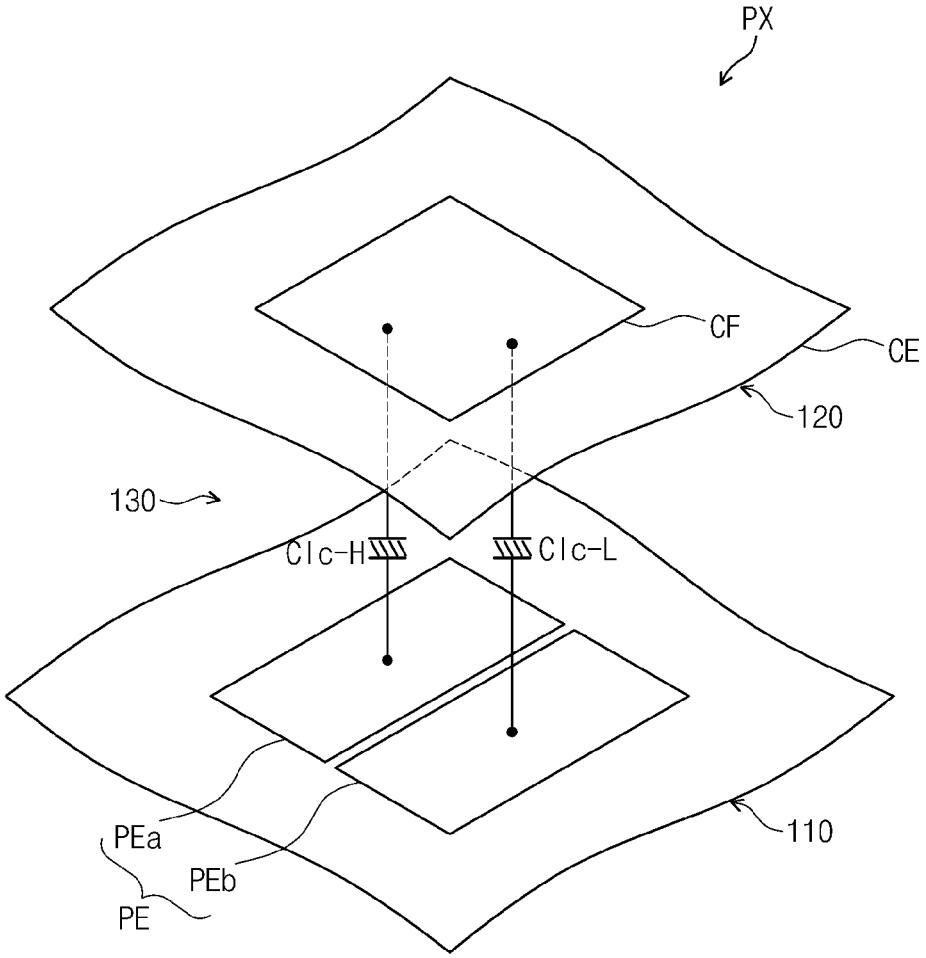
FIG. 2 is a perspective view showing one pixel shown in FIG. 1.

FIG. 1 is a block diagram showing a liquid crystal display 600, according to an exemplary embodiment of the present invention, and FIG. 2 is a perspective view showing one pixel shown in FIG. 1. Referring to FIG. 1, the liquid crystal display 600 includes a liquid crystal display panel 100, a timing controller 200, a gate driver 300, a data driver 400, and a gray-scale voltage generator 500.

The liquid crystal display panel 100 is connected to a plurality of signal lines and includes a plurality of pixels PX arranged in a matrix. As shown in FIG. 2, the liquid crystal display panel 100 may include a lower substrate 110, an upper substrate 120 facing the lower substrate 110, and a liquid crystal layer 130 disposed between the lower substrate 110 and the upper substrate 120.

The signal lines include a plurality of gate lines G1 to Gn that receive a gate signal and a plurality of data lines D1 to Dm that receive a data voltage. The gate lines G1 to Gn extend in a row direction and are arranged substantially parallel to each other. The data lines D1 to Dm extend in a column direction and are arranged substantially parallel to each other.

The pixels PX have the same structure and function, and thus, one pixel will be described in detail with reference to FIG. 2. As shown in FIG. 2, each pixel PX includes a first sub-pixel and a second sub-pixel. The first sub-pixel includes a first liquid crystal capacitor Clc_H, and the second sub-pixel includes a second liquid crystal capacitor Clc_L.

The lower substrate 110 includes a first sub-pixel electrode PEa as a first electrode of the first liquid crystal capacitor Clc_H and a second sub-pixel electrode PEb as a first electrode of the second liquid crystal capacitor Clc_L. The upper substrate 120 includes a common electrode CE as a second electrode of each of the first and second liquid crystal capacitors Clc_H and Clc_L. The liquid crystal layer disposed between the lower substrate 110 and the upper substrate 120 serves as a dielectric substance of each of the first and second liquid crystal capacitors Clc_H and Clc_L.

The first and second sub-pixel electrodes PEa and PEb are electrically insulated from each other and form one pixel electrode PE. The common electrode CE is formed on the upper substrate 120 to receive a common voltage Vcom. The liquid crystal layer 130 has a negative anisotropic dielectric constant. The liquid crystal molecules of the liquid crystal layer 130 may be aligned such that long axes thereof are vertically oriented with respect to the surface of the lower and upper substrates 110 and 120, when no electric field is applied. While not shown in FIG. 2, the common electrode CE may be provided on the lower substrate 110, and thus, at least one of the pixel electrode PE and the common electrode CE may be bar-shaped.

The liquid crystal display 600 may display desired colors by using a spatial division method in which each pixel PX displays one primary color, or a time division method in which each pixel PX sequentially displays the primary colors. The primary colors may be red, green, and blue. According to the spatial division method shown in FIG. 2, a color filter CF representing one of the three primary colors is disposed on the upper substrate 120 and faces each pixel. Although not shown in FIG. 2, the color filter CF may be disposed above or below the first and second sub-pixel electrodes PEa and PEb, on the lower substrate 110.

Referring again to FIG. 1, the timing controller 200 receives a plurality of image signals RGB and a plurality of control signals CS from outside of the liquid crystal display 600. The timing controller 200 converts the data format of the image signals RGB into a data format appropriate for an interface between the timing controller 200 and the data driver 400 and provides the converted image signals R'G'B' to the data driver 400. The timing controller 200 applies a data control signal CONT2, such as an output start signal, a horizontal start signal, etc., to the data driver 400. The timing controller 200 applies a gate control signal CONT1, such as a vertical start signal, a vertical clock signal, a vertical clock bar signal, etc., to the gate driver 300.

The gray-scale voltage generator 500 generates the gray-scale voltages related to the transmittance of the pixel PX or a reference gray-scale voltage. The reference gray-scale voltage may have a positive (+) value or a negative (−) value, with respect to the common voltage Vcom.

The gate driver 300 generates a gate signal including a gate on voltage Von or a gate off voltage Voff, in response to the gate control signal CONT1 provided from the timing controller 200. The gate signal is sequentially applied to the gate lines G1 to Gn of the liquid crystal display panel 100.

The data driver 400 starts its operation in response to the data control signal CONT2 provided from the timing controller 200 and converts the image signals R'G'B' into data voltages, based on the reference gray-scale voltage. The data voltages are applied to the data lines D1 to Dm of the liquid crystal display panel 100.

Each of the driving devices 200, 300, 400, and 500 may be directly mounted on the liquid crystal display panel 100 as driving chips, attached on the liquid crystal display panel 100 as a tape carrier package after being mounted on a flexible printed circuit film (not shown), or mounted on a separate printed circuit board (not shown). In addition, one or more of the driving devices 200, 300, 400, and 500 may be integrated in the liquid crystal display panel 100 through a thin film process. Further, the driving devices 200, 300, 400, and 500 may be integrated in one chip.

Figure 3:
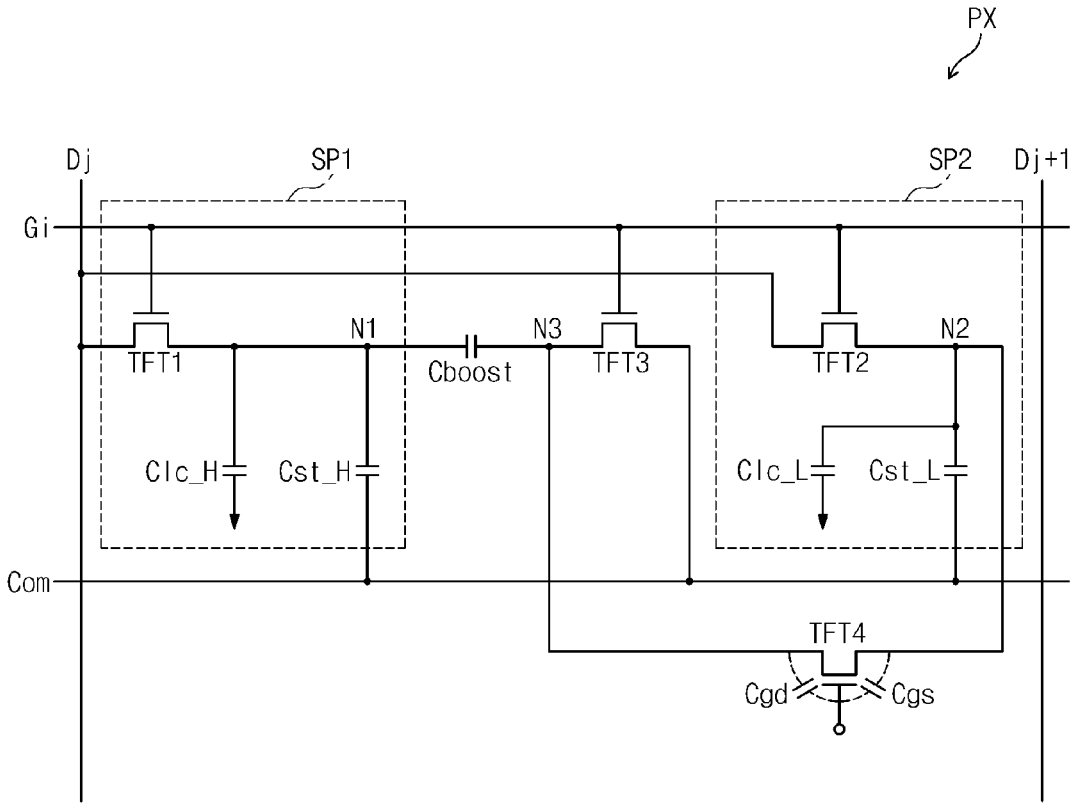
FIG. 3 is an equivalent circuit diagram of one pixel in the liquid crystal display shown in FIG. 1.

FIG. 3 is an equivalent circuit diagram of one pixel in the liquid crystal display shown in FIG. 1. Referring to FIG. 3, each pixel PX is connected to a corresponding first gate line Gi of the gate lines G1 to Gn, a corresponding first data line Dj of the data lines D1 to Dm, and a storage voltage line Com applied with a storage voltage.

Each pixel PX includes a first sub-pixel SP1 and a second sub-pixel SP2. The first sub-pixel SP1 includes a first thin film transistor TFT1, a first liquid crystal capacitor Clc_H, and a first storage capacitor Cst_H. The second sub-pixel SP2 includes a second thin film transistor TFT2, a second liquid crystal capacitor Clc_L, and a second storage capacitor Cst_L.

The first thin film transistor TFT1 includes a gate electrode connected to the first gate line Gi, a source electrode connected to the first data line Dj, and a drain electrode connected to the first liquid crystal capacitor Clc_H. The first storage capacitor Cst_H is electrically connected to the storage voltage line Com and the drain electrode of the first thin film transistor TFT1.

The second thin film transistor TFT2 includes a gate electrode connected to the first gate line Gi, a source electrode connected to the first data line Dj, and a drain electrode connected to the second liquid crystal capacitor Clc_L. The second storage capacitor Cst_L is electrically connected to the storage voltage line Com and the drain electrode of the second thin film transistor TFT2.

Each pixel PX further includes a third thin film transistor TFT3, a fourth thin film transistor TFT4, and a boost capacitor Cboost. The third thin film transistor TFT3 includes a gate electrode connected to the first gate line Gi, a source electrode electrically connected to the boost capacitor Cboost, and a drain electrode electrically connected to the storage voltage line Com. The boost capacitor Cboost includes a first electrode electrically connected to the source electrode of the third thin film transistor TFT3, and a second electrode electrically connected to the drain electrode of the first thin film transistor TFT1. The fourth thin film transistor TFT4 includes a gate electrode in a floating state, a source electrode connected to the drain electrode of the second thin film transistor TFT2, and a drain electrode connected to the first electrode of the boost capacitor Cboost.

When the gate on voltage is applied to the first gate line Gi, the first and second thin film transistors TFT1 and TFT2 are substantially simultaneously turned on, and the data voltage applied to the first data line Dj is charged in the first and second liquid crystal capacitors Clc_H and Clc_L, through the turned-on first and second thin film transistors TFT1 and TFT2. An electric potential at a first node N1 becomes equal to an electrical potential at a second node N2.

The data voltage charged in the first liquid crystal capacitor Clc_H and the second liquid crystal capacitor Clc_L controls the alignment of the liquid crystal molecules of the liquid crystal layer 130 shown in FIG. 2. In addition, the first storage capacitor Cst_H and the second storage capacitor Cst_L maintain the data voltage charged in the first liquid crystal capacitor Clc_H and the second liquid crystal capacitor Clc_L, during one frame period.

The boost capacitor Cboost reduces the voltage charged in the second liquid crystal capacitor Clc_L and increases the voltage charged in the first liquid crystal capacitor Clc_H, thereby enhancing the side visibility of the liquid crystal display 600.

The third thin film transistor TFT3 is turned on in response to the gate on voltage applied to the first gate line Gi, when the first and second thin film transistors TFT1 and TFT2 are turned on. The storage voltage is applied to the first electrode of the boost capacitor Cboost through the turned-on third thin film transistor TFT3, and the data voltage is applied to the second electrode of the boost capacitor Cboost through the turned-on first thin film transistor TFT1. The storage voltage may have the same level as the common voltage Vcom. Accordingly, the boost capacitor Cboost is charged with the voltage corresponding to the difference between the data voltage and the storage voltage.

The third thin film transistor TFT3 initializes the first electrode of the boost capacitor Cboost. In this case, the storage voltage serves as an initializing voltage for initializing the first electrode of the boost capacitor Cboost. When the gate off voltage is applied to the first gate line Gi, the first, second, and third thin film transistors TFT1, TFT2, and TFT3, the first sub-pixel SP1 and the second sub-pixel SP2 are electrically isolated from each other.

A predetermined time period after the first, second, and third thin film transistors TFT1, TFT2, and TFT3 are turned off, an electric potential at a third node N3 may be varied by a leakage current in the fourth thin film transistor TFT4. Therefore, the fourth thin film transistor TFT4 may be designed to have a leakage current that is smaller than a driving current of the first, second, and third thin film transistors TFT1, TFT2, and TFT3.

A high period of the gate signal is referred to as a horizontal scanning period, and a time period required to display one screen image is referred to as one frame period. The fourth thin film transistor TFT4 may be turned on at a point one frame period, after the horizontal scanning period has ended. For example, the size of the leakage current of the fourth thin film transistor TFT4 may be controlled by adjusting the capacitance of a first parasitic capacitor Cgd disposed between the gate electrode and the drain electrode of the fourth thin film transistor TFT4, and by adjusting the capacitance of a second parasitic capacitor Cgs disposed between the gate electrode and the source electrode of the fourth thin film transistor TFT4.

Consequently, although the gate electrode of the fourth thin film transistor TFT4 is in the floating state, the drain electrode of the second thin film transistor TFT2 may be electrically connected to the first electrode of the boost capacitor Cboost by the leakage current. Thus, the electric potential at the second node N2 becomes equal to the electric potential at the third node N3, and the electric potential at the first node N1 becomes different from the electric potential at the second node N2.

Referring to FIG. 3, the first node N1 is positioned between the drain electrode of the first thin film transistor TFT1 and the second electrode of the boost capacitor Cboost. The second node N2 is positioned between the drain electrode of the second thin film transistor TFT2 and the source electrode of the fourth thin film transistor TFT4. The third node N3 is positioned between the first electrode of the boost capacitor Cboost and the drain electrode of the fourth thin film transistor TFT4.

When the gate on voltage is applied through the first gate line Gi, the data voltage Vd is applied to the first node N1 and the second node N2 through the first thin film transistor TFT1 and the second thin film transistor TFT2. In addition, the storage voltage is applied to the third node N3 through the third thin film transistor TFT3. For the convenience of explanation, the storage voltage is assumed to be zero (0) volts. Accordingly, the first node N1 and the second node N2 are applied with the data voltage Vd, and the third node N3 is applied with the storage voltage of 0V.

According to the conservation law of electric charge, an electric charge amount Qh charged in the first liquid crystal capacitor Clc_H and the first storage capacitor Cst_H, an electric charge amount Ql charged in the second liquid crystal capacitor Clc_L and the second storage capacitor Cst_L, and an electric charge amount Qb charged in the boost capacitor Cboost may be represented by the following Equation 1.

$$Qh=Ch\times Vd$$

$$Ql=Cl\times Vd$$

$$Qb=Cb\times Vd \qquad \text{Equation 1}$$

In Equation 1, "Ch" and "Cl" satisfy the following Equation 2, and "Cb" is defined as a capacitance of a charge-sharing capacitor.

$$Ch=Clc_H+Cst_H$$

$$Cl=Clc_L+Cst_L \qquad \text{Equation 2}$$

When the gate off voltage is applied to the first gate line Gi, the first to third thin film transistors TFT1 to TFT3 are turned off. When the leakage current of the fourth thin film transistor TFT4 is increased, the fourth thin film transistor TFT4 is turned on.

In this case, according to the conservation law of electric charge, an electric charge amount Qh' charged in the first liquid crystal capacitor Clc_H and the first storage capacitor Cst_H, an electric charge amount Ql' charged in the second liquid crystal capacitor Clc_L and the second storage capacitor Cst_L, and an electric charge amount Qb' charged in the boost capacitor Cboost may be represented by the following Equation 3.

$$Qh'=Ch\times V1$$

$$Ql'=Cl\times V2$$

$$Qb'=Cb\times(V1-V2) \qquad \text{Equation 3}$$

In Equation. 3, V1 is a voltage applied to the first node N1 and "V2" is a voltage applied to the second node N2.

Since the total electric charge amount charged in the first liquid crystal capacitor Clc_H, the first storage capacitor Cst_H, and the boost capacitor Cboost, which are connected to the first node N1, is conserved, the following Equation 4 is obtained.

$$Qh+Qb=Qh'+Qb' \qquad \text{Equation 4}$$

Since the total electric charge stored in the second liquid crystal capacitor Clc_L, the second storage capacitor Cst_L, and the boost capacitor Cboost, which are connected to the third node N3, is conserved, the following Equation 5 is obtained.

$$Ql-Qb=Ql'-Qb' \qquad \text{Equation 5}$$

Based on Equations 1 to 5, the voltages V1 and V2 at the first node N1 and the second node N2 are represented by the following Equations 6A and 6B.

$$V1=Vd\left(1+\frac{Ch\cdot Cb}{Cl\cdot Ch+Ch\cdot Cb+Cb\cdot Cl}\right) \qquad \text{Equation 6A}$$

$$V2=Vd\left(1+\frac{Cl\cdot Cb}{Cl\cdot Ch+Ch\cdot Cb+Cb\cdot Cl}\right) \qquad \text{Equation 6B}$$

When the data voltage Vd is a positive (+) voltage that is larger than the common voltage Vcom, the voltage V1 at the first node N1 becomes higher than the data voltage Vd, and the voltage V2 at the second node N2 becomes lower than the data voltage Vd. When the data voltage Vd is a negative (−) voltage that is smaller than the common voltage Vcom, the voltage V1 at the first node N1 becomes lower than the data voltage Vd, and the voltage V2 at the second node N2 becomes higher than the data voltage Vd. Thus, the voltage V1 stored in the first liquid crystal capacitor Clc_H of the first sub-pixel SP1 becomes larger than the voltage V2 stored in the second liquid crystal capacitor Clc_L of the second sub-pixel SP2.

As described above, when the voltages V1 and V2, respectively charged in the first and second sub-pixels SP1 and SP2 of one pixel PX, have different values, the side visibility may be improved. In detail, when voltages respectively obtained from two gamma curves having different gamma values, which are obtained from one image, are respectively applied to the first sub-pixel SP1 and the second sub-pixel SP2, a composite gamma curve of the corresponding pixel corresponds to a combination of the two gamma curves. The composite gamma curve approaches a reference gamma curve, when the composite gamma curve is measured from in front of the display and when measured from the side of the display. Thus, the side visibility (viewing angle) may be improved.

Figure 4:
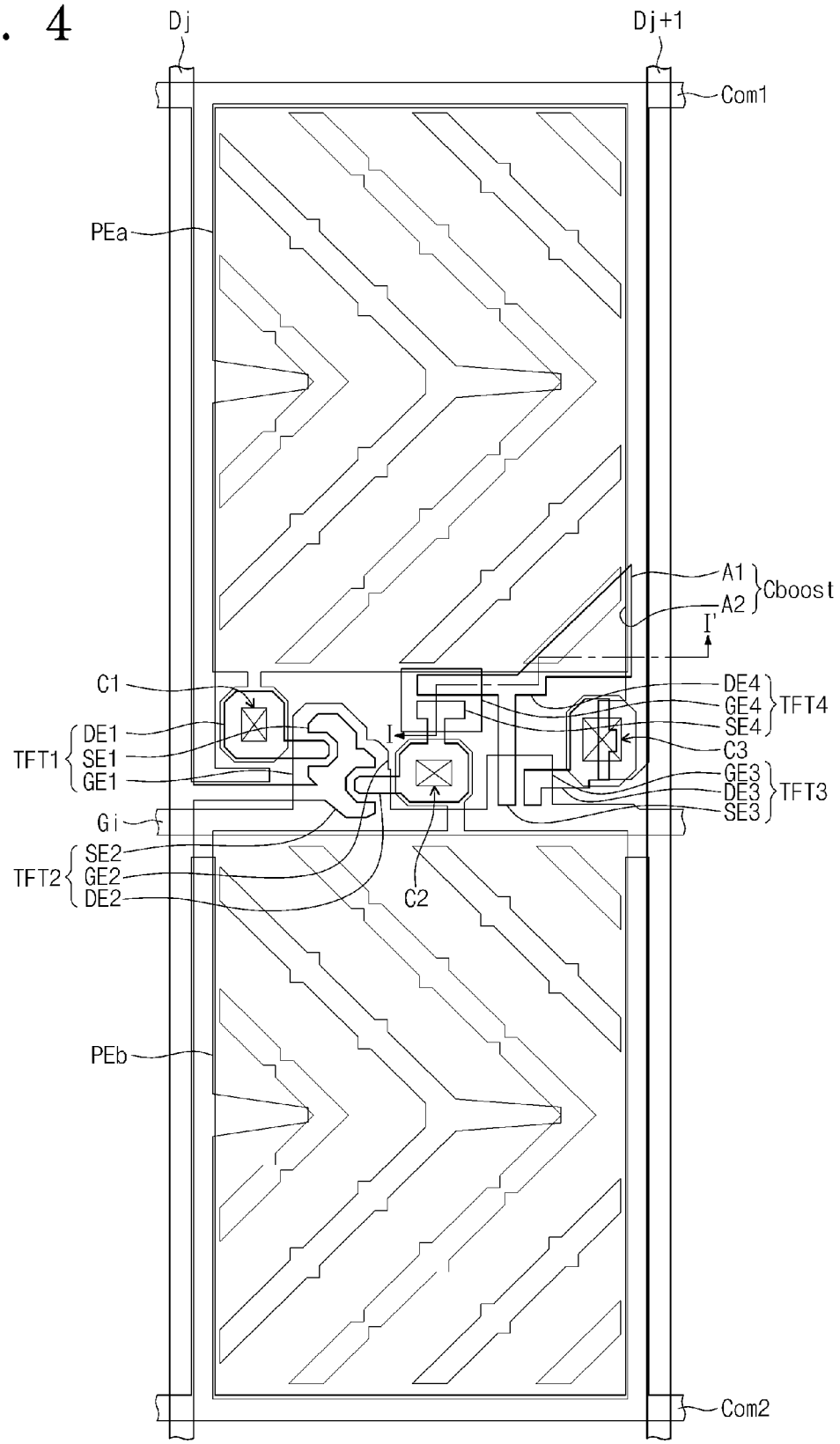
FIG. 4 is a plan view showing a layout of a pixel corresponding to the equivalent circuit diagram shown in FIG. 3.
Figure 5:
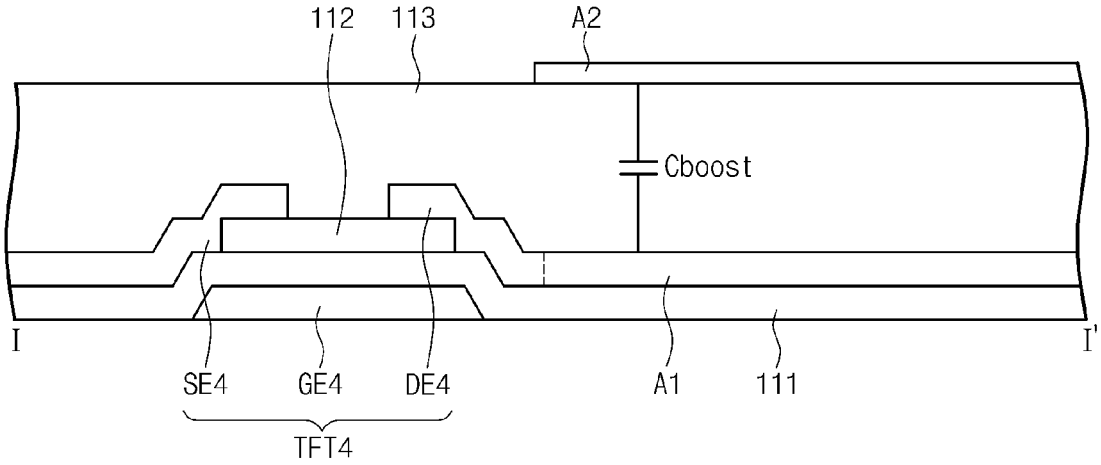
FIG. 5 is a cross-sectional view taken along a line I-I' shown in FIG. 4.

FIG. 4 is a plan view showing a layout of a pixel corresponding to the equivalent circuit diagram shown in FIG. 3, and FIG. 5 is a cross-sectional view taken along a line I-I' shown in FIG. 4. Referring to FIGS. 4 and 5, the gate electrode GE1 of the first thin film transistor TFT1 branches off from the first gate line Gi, the source electrode SE1 of the first thin film transistor TFT1 branches off from the first data line Dj, and the drain electrode DE1 of the first thin film transistor TFT1 is electrically connected to the first sub-pixel electrode PEa at a first contact point C1.

The first sub-pixel electrode PEa forms the first liquid crystal capacitor Clc_H in conjunction with the common electrode CE formed on the upper substrate 120. The first sub-pixel electrode PEa also overlaps with the first storage voltage line Com1 to form the first storage capacitor Cst_H. The gate electrode GE2 of the second thin film transistor TFT2 branches off from the first gate line Gi, the source electrode SE of the second thin film transistor TFT2 branches off from the first data line Dj, and the drain electrode DE of the second thin film transistor TFT2 is electrically connected to the second sub-pixel electrode PEb at a second contact point C2.

The second sub-pixel electrode PEb forms the second liquid crystal capacitor Clc_L in conjunction with the common electrode CE formed on the upper substrate 120. The second sub-pixel electrode PEb also overlaps with the second storage voltage line Com2 to form the second storage capacitor Cst_L. The gate electrode GE3 of the third thin film transistor TFT3 branches off from the first gate line Gi, the source electrode of the third thin film transistor TFT3 is connected to the first electrode A1 of the boost capacitor Cboost, and the drain electrode DE3 of the third thin film transistor TFT3 is electrically connected to the first storage voltage line Com1 at a third contact point C3.

The gate electrode GE4 of the fourth thin film transistor TFT4 is formed in an island shape and in an electrically floating state. The source electrode SE4 of the fourth thin film transistor TFT4 extends from the drain electrode DE2 of the second thin film transistor TFT2. The drain electrode DE4 of the fourth thin film transistor TFT4 extends from the source electrode SE3 of the third thin film transistor TFT3.

The first electrode A1 of the boost capacitor Cboost extends from the drain electrode DE4 of the fourth thin film transistor TFT4. The second electrode A2 of the boost capacitor Cboost extends from the first sub-pixel electrode PEa. The boost capacitor Cboost is formed by a first electrode extended from the drain electrode DE4, a second electrode extended from the first sub-pixel electrode PEa, and a protective layer 113 disposed between the first and second electrodes.

In FIG. 5, a reference numeral 111 denotes a gate insulating layer and a reference numeral 112 denotes a semiconductor layer of the fourth thin film transistor TFT4. The semiconductor layer 112 may be formed of amorphous silicon, polycrystalline silicon, or single crystalline silicon.

Figure 6:
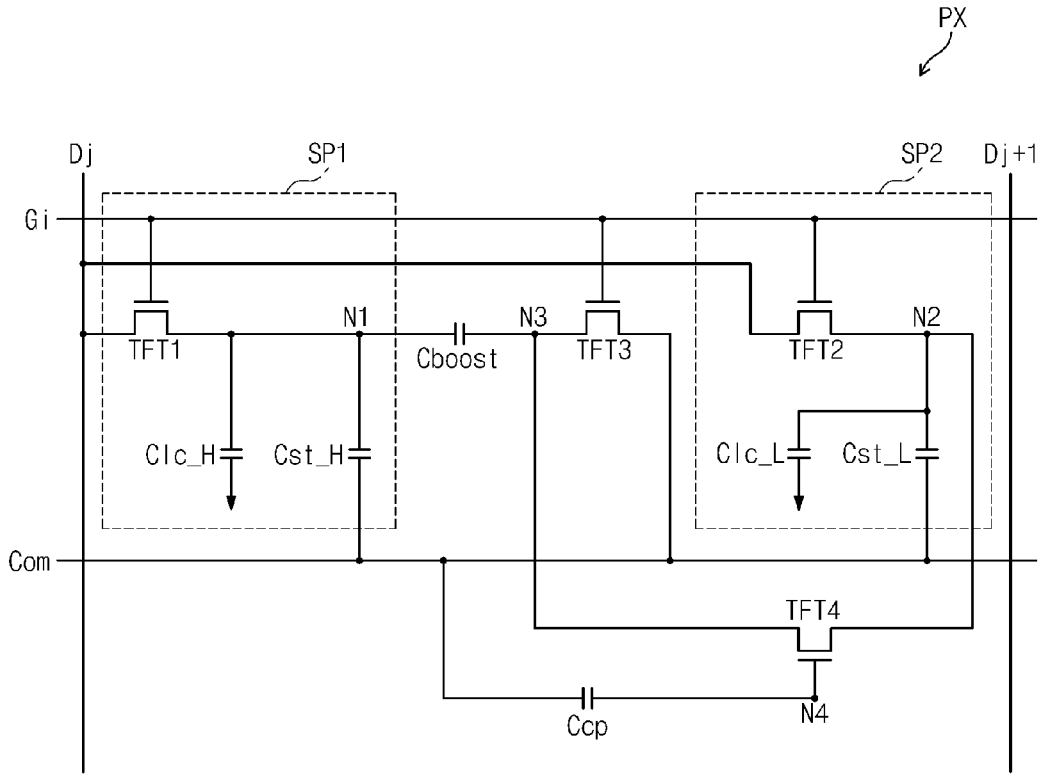
FIG. 6 is an equivalent circuit diagram of one pixel of a liquid crystal display, according to another exemplary embodiment of the present invention.

FIG. 6 is an equivalent circuit diagram of one pixel in a liquid crystal display, according to another exemplary embodiment of the present invention. In FIG. 6, the same reference numerals denote the same elements in FIG. 3, and thus, detailed descriptions of the same elements will be omitted.

Referring to FIG. 6, each pixel further includes a coupling capacitor Ccp connected between the gate electrode of the fourth thin film transistor TFT4 and the storage voltage line Com. The gate electrode of the fourth thin film transistor TFT4 is in a floating state.

However, since the storage voltage of about 7 volts to about 8 volts is applied to the storage voltage line Com, the gate electrode of the fourth thin film transistor TFT4 may have an electric potential approximately equal to the storage voltage of the coupling capacitor Ccp. As described above, when the gate electrode of the fourth thin film transistor TFT4 has the electric potential approximately equal to the storage voltage of the coupling capacitor Ccp, the time needed to stabilize the first and second pixel voltages V1 and V2 may be shortened.

Figure 7:
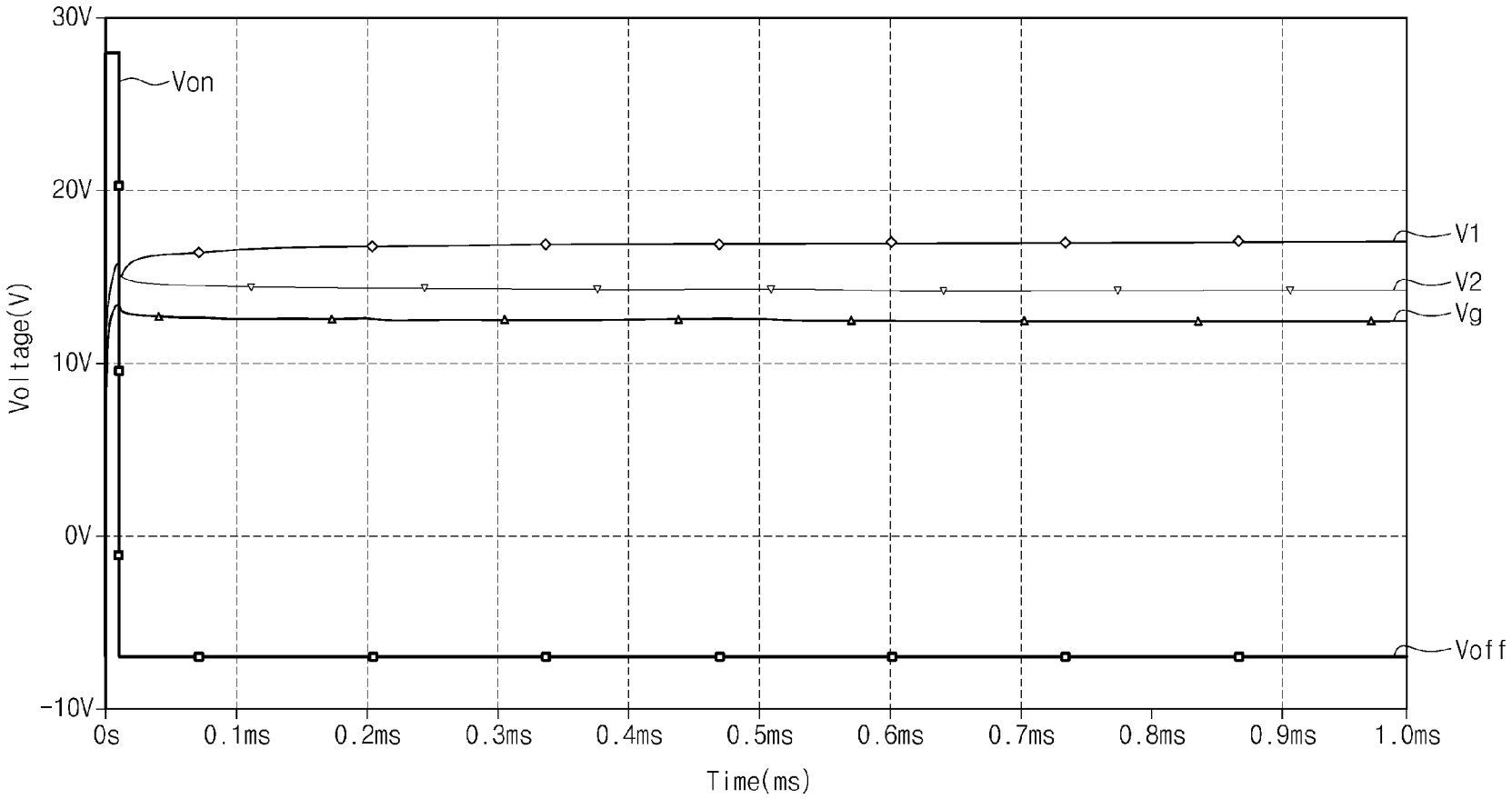
FIG. 7 is a graph showing electric potentials of a first node, a second node, and a fourth node.

FIG. 7 is a graph showing electric potentials of the first node, the second node, and the fourth node. Referring to FIGS. 6 and 7, when the gate on voltage Von of about 28 volts is applied to the first gate line Gi, the data voltage is applied to the first and second nodes N1 and N2. Then, when the gate off voltage Voff of about −7 volts is applied to the first gate line Gi, the electric potential at the first node N1 is increased and the electric potential at the second node N2 is decreased, by the boost capacitor Cboost.

When assuming that the storage voltage of about 8 volts is applied to the storage voltage line Com, the capacitance of the coupling capacitor Ccp is about 0.2p, the capacitance of the boost capacitor Cboost is about 0.35p, and the fourth node N4 has the electric potential of about 13 volts. In this case, the electric potential at the first node N1 is maintained at the first pixel voltage V1 for 1 millisecond or less, and the electric potential at the second node N2 is maintained at the second pixel voltage V2 for 1 millisecond or less.

Figure 8:
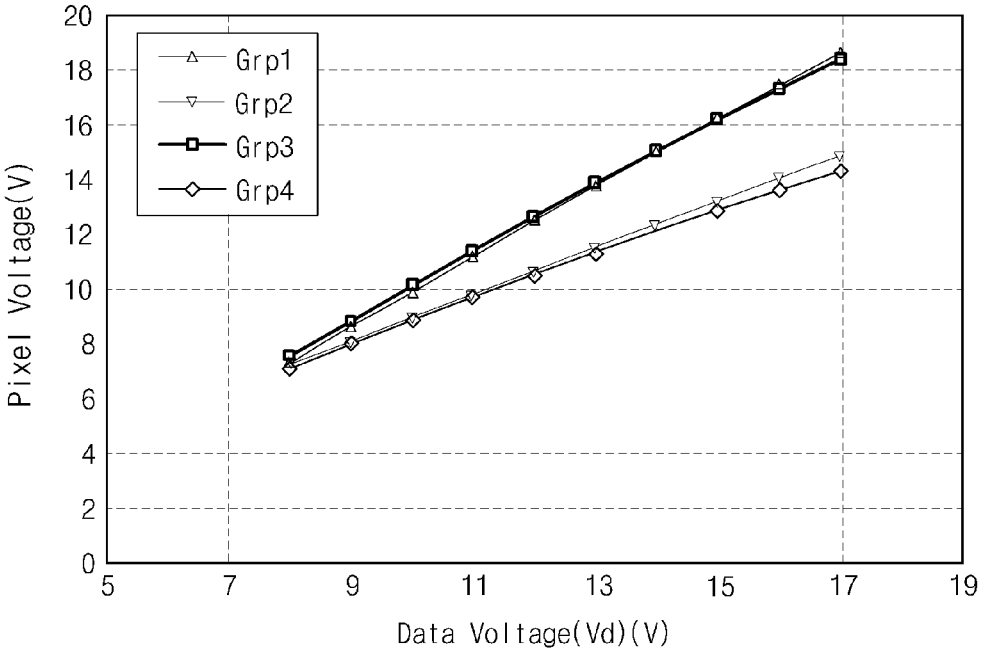
FIG. 8 is a graph showing a variation of first and second pixels, according to application of a control signal to a gate electrode of a fourth thin film transistor.

FIG. 8 is a graph showing a variation of first and second pixels, according to the application of the control signal to the gate electrode of the fourth thin film transistor TFT4. In FIG. 8, a first graph Grp1 represents the first pixel voltage V1 according to the data voltage Vd, when the control signal is applied to the gate electrode of the fourth thin film transistor TFT4, and a second graph Grp2 represents the second pixel voltage V2 according to the data voltage Vd, when the control signal is applied to the gate electrode of the fourth thin film transistor TFT4. A third graph Grp3 represents the first pixel voltage V1 according to the data voltage Vd, when the gate electrode of the fourth thin film transistor TFT4 is in the floating state, and the fourth graph Grp4 represents the second voltage V2 according to the data voltage Vd, when the gate electrode of the fourth thin film transistor TFT4 is in the floating state.

Referring to FIG. 8, the first and second pixel voltages V1 and V2, as measured when the gate electrode of the fourth thin film transistor TFT4 is in the floating state (a first case), are similar to the first and second voltages V1 and V2, as measured when the control signal is applied to the gate electrode of the fourth thin film transistor TFT4 (a second case).

The capacitance of the boost capacitor Cboost is about 0.3p in the first case, but the capacitance of the boost capacitor Cboost is increased to 0.35p in the second case. Therefore, the first and second pixel voltages V1 and V2 that similar to those of the first case may be obtained in the second case.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display apparatus comprising:

gate lines configured to receive a gate signal;

data lines configured to receive a data signal; and pixels, each pixel comprising:

a pixel electrode comprising a first sub-pixel electrode and a second sub-pixel electrode;

a first switching device connected to at least one of the gate lines, at least one of the data lines, and the first sub-pixel electrode;

a second switching device connected to the at least one of the gate lines, the at least one of the data lines, and the second sub-pixel electrode;

a boost capacitor connected to the first sub-pixel electrode;

a third switching device connected to the at least one of the gate lines, the boost capacitor, and a storage voltage line; and a fourth switching device comprising a gate electrode in a floating state and not connected to the gate lines, the fourth switching device connected to the second sub-pixel electrode and the boost capacitor, wherein a driving current of the first and third switching devices is greater than a leakage current of the fourth switching device.

2. The display apparatus of claim 1, wherein:

the first switching device comprises:

a gate electrode connected to the at least one of the gate lines;

a source electrode connected to the at least one of the data lines; and a drain electrode connected to the first sub-pixel electrode; and the second switching device comprises:

a gate electrode connected to the at least one of the gate lines;

a source electrode connected to the at least one of the data lines; and a drain electrode connected to the second sub-pixel electrode.

3. The display apparatus of claim 1, wherein each of the pixels further comprises a storage voltage line to receive a storage voltage.

4. The display apparatus of claim 3, wherein the third switching device comprises:

a gate electrode connected to the at least one of the gate lines;

a source electrode connected to the boost capacitor; and a drain electrode connected to the storage voltage line.

5. The display apparatus of claim 3, wherein each of the pixels further comprises a coupling capacitor connected to the gate electrode of the fourth switching device and the storage voltage line.

6. The display apparatus of claim 1, wherein the fourth switching device further comprises:

a source electrode connected to the second sub-pixel electrode; and a drain electrode connected to the boost capacitor.

7. The display apparatus of claim 6, wherein the boost capacitor comprises:

a first electrode extending from the drain electrode of the fourth switching device;

a second electrode extending from the first sub-pixel electrode; and a dielectric layer disposed between the first electrode and the second electrode.

8. The display apparatus of claim 1, further comprising:

a common electrode facing the first and second sub-pixel electrodes; and a liquid crystal layer disposed between the common electrode and the first and second sub-pixel electrodes.

9. The display apparatus of claim 1, wherein the boost capacitor increases a grayscale level of the first sub-pixel electrode and decreases a grayscale level of the second sub-pixel electrode.

* * * * *